US008727348B2

(12) United States Patent
Tsai

(10) Patent No.: US 8,727,348 B2
(45) Date of Patent: May 20, 2014

(54) AIR-BLOWING ASSEMBLY OF GAME TABLE

(75) Inventor: Jason Tsai, Taichung (TW)

(73) Assignee: Zhejiang Elephant Sport Co., Ltd., Jiashan, Zhejiang (CN)

( * ) Notice: Subject to any disclaimer, the term of this patent is extended or adjusted under 35 U.S.C. 154(b) by 98 days.

(21) Appl. No.: 13/440,242

(22) Filed: Apr. 5, 2012

(65) Prior Publication Data

US 2013/0264772 A1 Oct. 10, 2013

(51) Int. Cl.
*A63F 7/00* (2006.01)
*A63F 7/06* (2006.01)

(52) U.S. Cl.
USPC ..... 273/108.1; 273/126 A; 273/129 AP

(58) Field of Classification Search
USPC ..... 273/120 A, 121 A, 122 A, 119 A, 124 A, 273/125 A, 123 A, 118 A, 126 A, 129 AP, 273/454, 460, 108, 108.1, 126 R
See application file for complete search history.

(56) References Cited

U.S. PATENT DOCUMENTS 3,415,478 A * 12/1968 Williams, III ..... 248/346.4
3,871,585 A * 3/1975 Crossman et al. ..... 239/553.3
3,887,187 A * 6/1975 Crossman et al. ..... 273/126 A
3,954,267 A * 5/1976 Freeman et al. ..... 273/126 A
4,017,078 A * 4/1977 Goldfarb et al. ..... 273/126 A
4,173,341 A * 11/1979 Olliges ..... 273/126 A
4,468,029 A * 8/1984 Kulesza et al. ..... 273/108
5,029,861 A * 7/1991 Driska ..... 273/108.53
5,104,607 A * 4/1992 Driska ..... 264/536
5,110,128 A * 5/1992 Robbins ..... 273/126 A
5,356,143 A * 10/1994 Hylak ..... 273/126 A
5,556,093 A * 9/1996 Lankiewicz et al. ..... 273/126 A
5,788,231 A * 8/1998 To ..... 273/126 R
5,931,465 A * 8/1999 Miyake et al. ..... 273/108.1
6,003,866 A * 12/1999 Tsai ..... 273/126 A
6,105,960 A * 8/2000 Carames ..... 273/108.1
6,109,607 A * 8/2000 Cartwright et al. ..... 273/108.1
6,279,905 B1 * 8/2001 Malavazos et al. ..... 273/126 A
6,419,224 B1 7/2002 Tsai
6,454,260 B1 * 9/2002 Noolandi et al. ..... 273/108
7,357,392 B1 * 4/2008 Wu ..... 273/126 A
7,389,987 B1 * 6/2008 Paukert ..... 273/108.1
8,267,804 B1 * 9/2012 Tsai ..... 473/14
8,336,880 B2 * 12/2012 Crawford et al. ..... 273/126 A
8,434,762 B1 * 5/2013 Kerpovich ..... 273/126 A
2005/0151316 A1 * 7/2005 Nally et al. ..... 273/126 A

* cited by examiner

*Primary Examiner* — Sebastiano Passaniti
(74) *Attorney, Agent, or Firm* — Guice Patents PLLC

(57) ABSTRACT

An air-blowing assembly of game table, which is installed in a table frame of the game table, includes a face board, an inner board and an air space defined between the boards. One or more flow guide members are arranged in the air space, each flow guide member has multiple lattices arranged in rows. At least one air guide channel is formed on each flow guide member so that at least one lattice row has longitudinal notches and/or lateral notches. Accordingly, the flow guide member has longitudinal and/or transverse airflow passages. A fan is used to blow air into the air space. Under the guide of the air guide channels, the air flows out of the face board from fine orifices thereof.

20 Claims, 19 Drawing Sheets

AIR-BLOWING ASSEMBLY OF GAME TABLE

BACKGROUND OF THE INVENTION

1. Field of the Invention

The present invention relates generally to a game table, and more particularly to an air-blowing assembly of a game table. The air-blowing assembly is able to blow air out of the table face of the game table.

2. Description of the Related Art

A hockey game table or a game table with a hockey game table face provides a hockey game simulating hockey sport. The conventional hockey game table is designed with an air-blowing mechanism for blowing air out of the table face so as to reduce the frictional resistance against the slide of the puck on the table face. The table body of such game table has an internal space positioned under the table face. The table face is formed with numerous fine orifices densely distributed over the table face. A fan is used to blow air into the space and make the air flow out from the fine orifices.

In order to guide the air to flow within the space, U.S. Pat. No. 6,419,224 discloses a complex multifunctional game table structure in which a wooden wind-guiding board is installed in the table body as shown in FIGS. 1 to 4 of the above Patent. The wind-guiding board is formed with wind-guiding channels for guiding the air to every part of the space.

The wooden wind-guiding board is made of a considerably large amount of timbers and is manufactured at higher cost. This fails to meet the requirement of environmental protection. Also, it is hard to manufacture the wooden wind-guiding board. Moreover, it is necessary to secondarily process the timbers. As a result, the wind-guiding board is likely to warp and lose its planarity. Accordingly, the wind-guiding board is often manufactured with an error in size. This will lead to difficulty in assembling the wind-guiding board. Furthermore, the wooden board has a quite heavy weight. This fails to meet the requirement of lightening.

In addition, the wind-guiding channel formed on the wind-guiding board has no transverse (widthwise) air outlet. Therefore, the air can only flow along the wind-guiding channel in the longitudinal (lengthwise) direction thereof. Under such circumstance, the resistance against the flowing of the air is quite large so that it is hard to uniformly guide the air.

SUMMARY OF THE INVENTION

It is therefore a primary object of the present invention to provide an air-blowing assembly of a game table. The air-blowing assembly is able to guide air to uniformly flow within the interior of the game table under lower resistance against the flowing of the air.

It is a further object of the present invention to provide the above air-blowing assembly of the game table, which includes one or more flow guide members. The flow guide members are plane and unlikely to warp. In addition, the flow guide members are easy to manufacture and easy to assemble in the air-blowing assembly.

It is still a further object of the present invention to provide the above air-blowing assembly of the game table, which includes one or more flow guide members. The flow guide members are made of recoverable material to meet the requirement of environmental protection. In addition, the flow guide members are lighter than the conventional wooden board to meet the requirement of lightening.

The air-blowing assembly of the game table of the present invention is installed in a table frame of the game table, which includes a face board, an inner board and an air space defined between the face board and the inner board. One or more flow guide members are arranged in the air space. Each flow guide member has multiple lattices arranged in at least two rows. At least one air guide channel is formed on each flow guide member, and the air guide channel has at least one lattice row formed with longitudinal notches. Accordingly, the flow guide member has at least one longitudinal airflow passage. At least one fan is used to blow air into the air space. Under the guide of the flow guide members, the air can flow to every part of the air space and flow out of the face board from multiple fine orifices thereof.

In the above air-blowing assembly, the air guide channel can also form lateral notches on the lattice row of the flow guide member to provide transverse airflow passages, whereby the air can flow between the lattices of different lattice rows.

The air can flow out of the flow guide member through the lateral notches.

Preferably, the flow guide members are made of paperboards and are easy to manufacture and assemble. Moreover, the flow guide members have the advantages of planarity, low cost, lightweight and low resistance. In addition, the flow guide members are able to bear heavy load.

Multiple flow guide members can be arranged in the air space to partition the air space into multiple elongated compartments. Alternatively, a one-piece flow guide member with a size approximately equal to that of the air space can be arranged in the air space.

The present invention can be best understood through the following description and accompanying drawings, wherein:

DETAILED DESCRIPTION OF THE PREFERRED EMBODIMENTS

Figure 1:
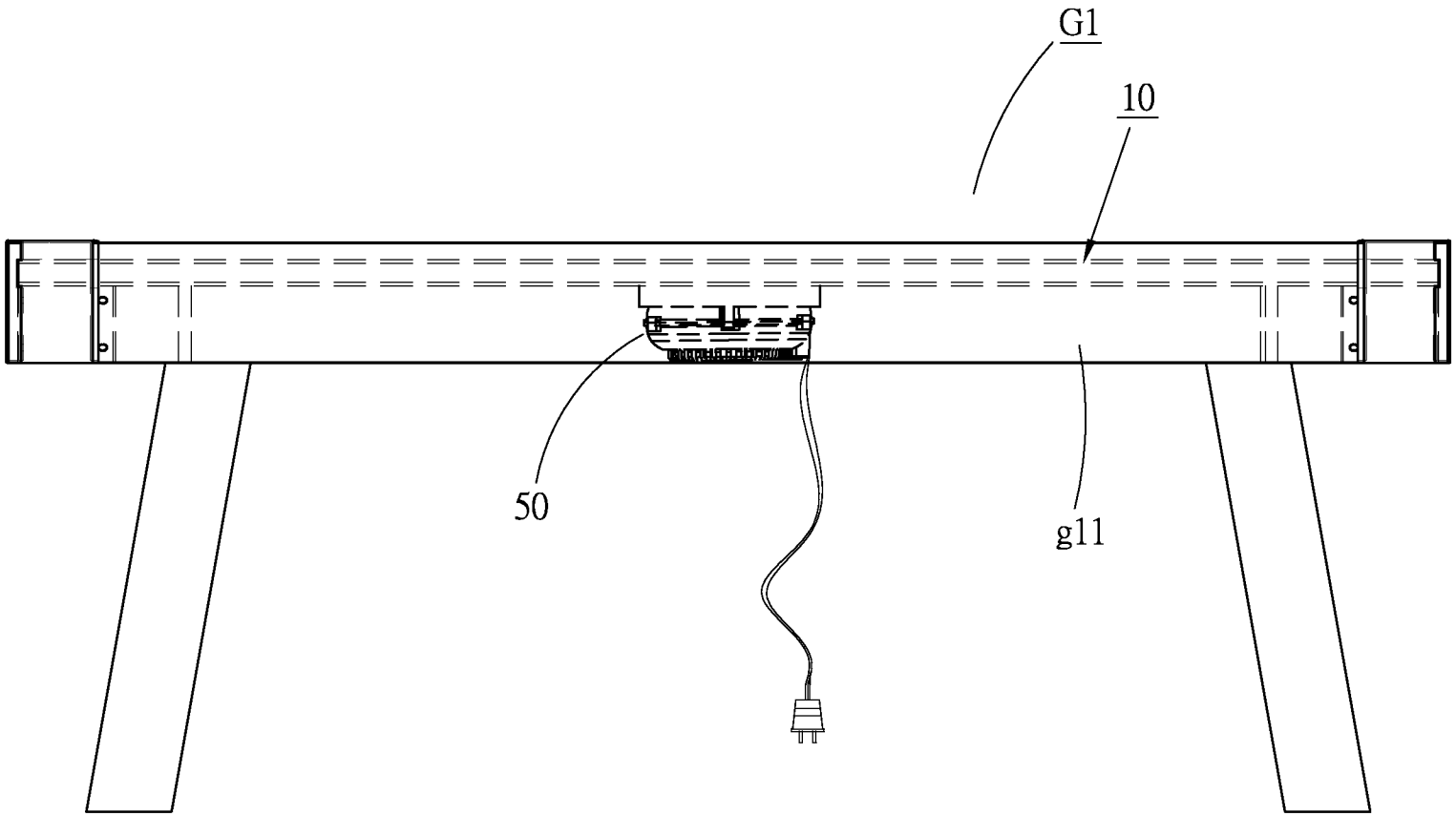
FIG. 1 is a plane view showing that a first embodiment of the present invention is applied to a kind of game table.
Figure 2:
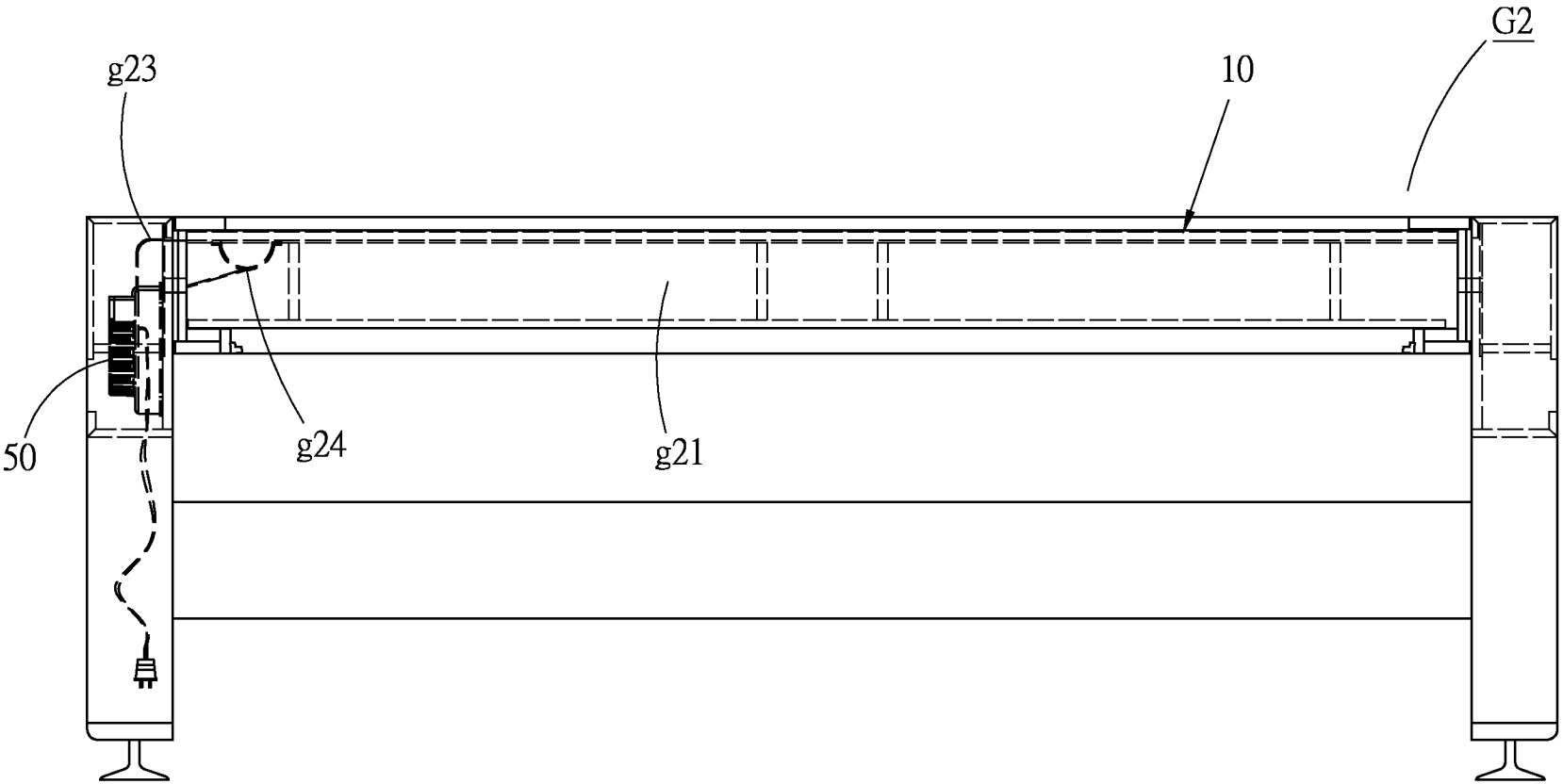
FIG. 2 is a plane view showing that the first embodiment of the present invention is applied to another kind of game table.

The present invention relates to an air-blowing assembly installed on a game table. The game table provides a hockey game. The air-blowing assembly 10 is installable on a game table G1 as shown in FIG. 1, which is a hockey game table. The air-blowing assembly 10 is installed in a table frame g11 to provide a hockey game table face for the game table. A fan 50 is mounted under a bottom face of the air-blowing assembly 10 for blowing airflow into the air-blowing assembly 10. Alternatively, the air-blowing assembly 10 can be installed on a game table G2 as shown in FIG. 2. The table frame g21 of the game table is pivotally rotatably disposed on a table body. The top and bottom faces of the table frame g21 provide two different kinds of game table faces, for example, a hockey game table face and a billiard game table face, which can be switched. The air-blowing assembly 10 of the present invention is one of the two game table faces of the table frame g21 for providing a hockey game. A fan 50 is used to blow airflow into the air-blowing assembly 10. The fan 50 is, but not limited to, installed in the table frame g21 and positioned between the two game table faces. Alternatively, the air-blowing assembly 10 can be arranged at one end of the table body of the game table as shown in FIG. 2. A wind conduit g23 is connected between the fan and the air-blowing assembly 10 for blowing air into the air-blowing assembly 10. The wind conduit has an air outlet g24 at one end. The air outlet g24 is connected to a bottom face or a periphery of the air-blowing assembly 10.

Figure 3:
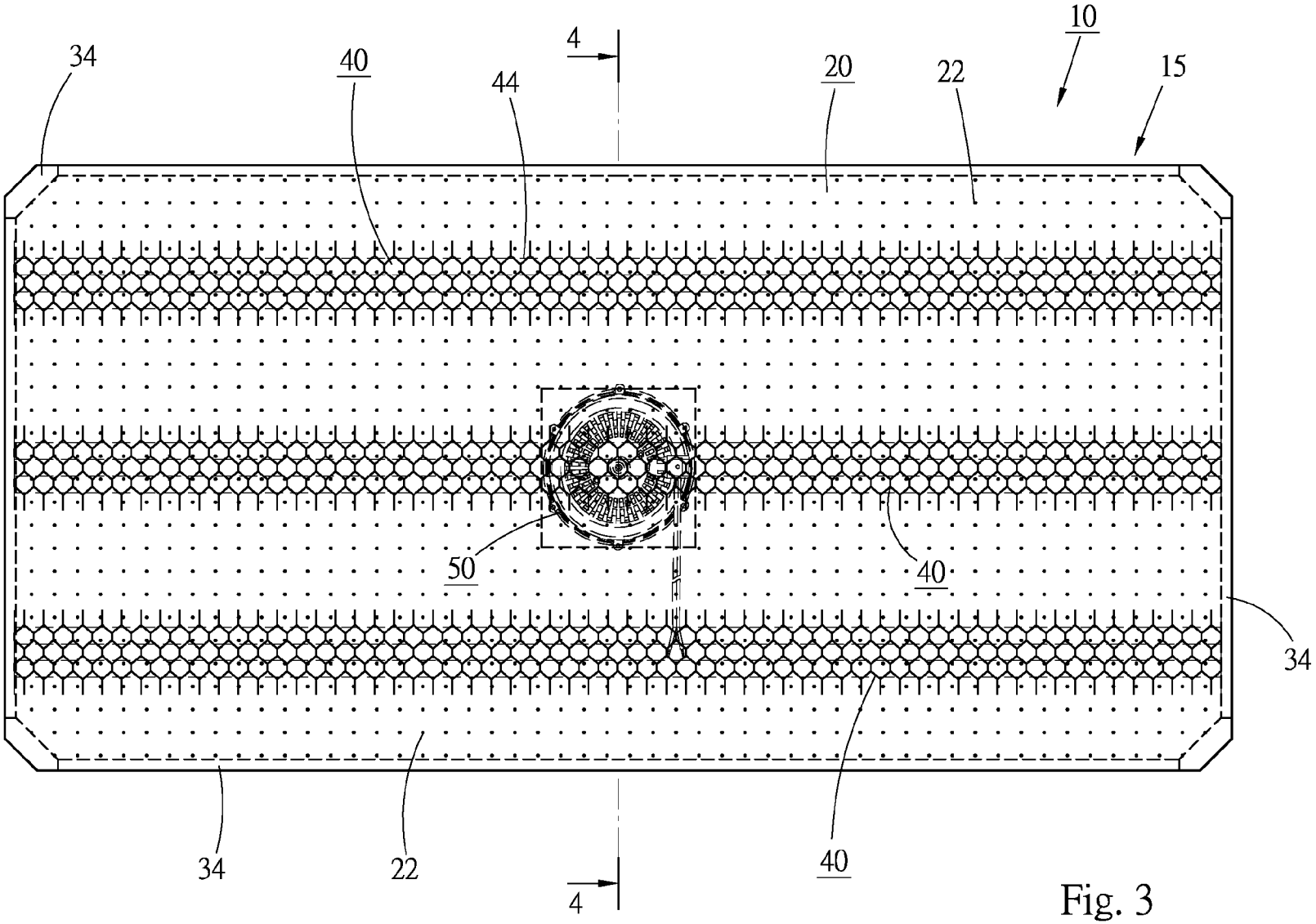
FIG. 3 is a top view of the first embodiment of the present invention.
Figure 4:
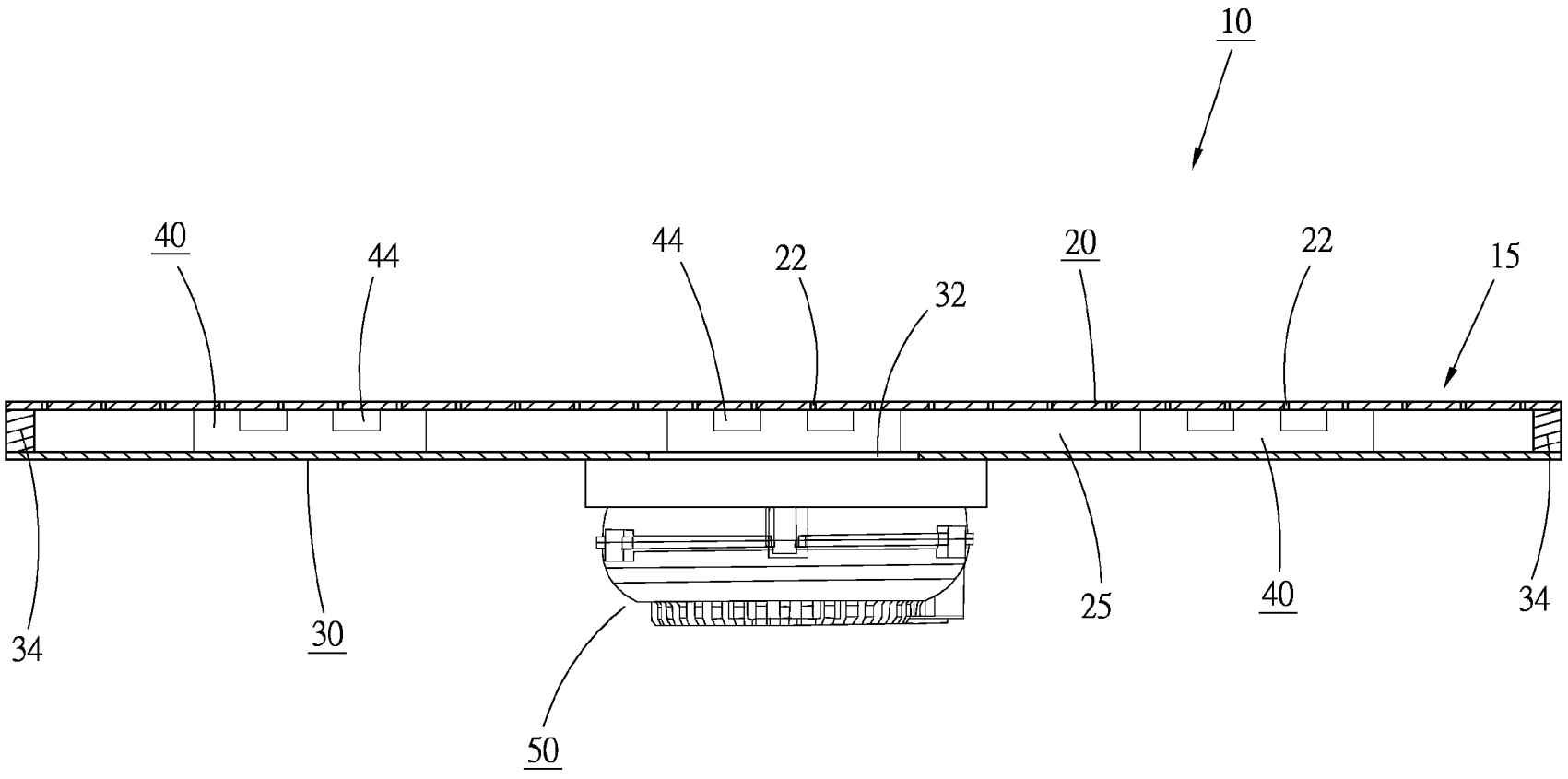
FIG. 4 is a sectional view taken along line 4-4 of FIG. 3.

Please refer to FIGS. 3 and 4. According to a first embodiment, the air-blowing assembly 10 of the present invention includes a flow guide module 15 and a fan 50. The flow guide module includes a face board 20, an inner board 30 and one or more flow guide members 40 disposed between the face board 20 and the inner board 30.

The face board 20 is formed with multiple fine orifices 22 densely distributed over the face board 20 and passing through the face board 20 from a top face to a bottom face thereof. The fine orifices are regularly arranged, for example, longitudinally and transversely arranged.

The inner board 30 is positioned under the face board 20 to define an air space 25 between the face board 20 and the inner board 30. An air inlet 32 is disposed on the inner board. The periphery of the space 25 is sealed with several strip-shaped sealing members 34. As shown in FIG. 4, the sealing members 34 are assembled between the face board 20 and the inner board 30. The configuration of the sealing member 34 is not limited to that as shown in FIG. 4. Alternatively, the sealing member 34 can be a strip member with C-shaped cross section for holding the peripheries of the face board and the inner board. Still alternatively, in the case that the air-blowing assembly 10 is installed on the game table G1 or G2, the periphery of the space can be sealed with the table frame g11 or g21.

Figure 5:
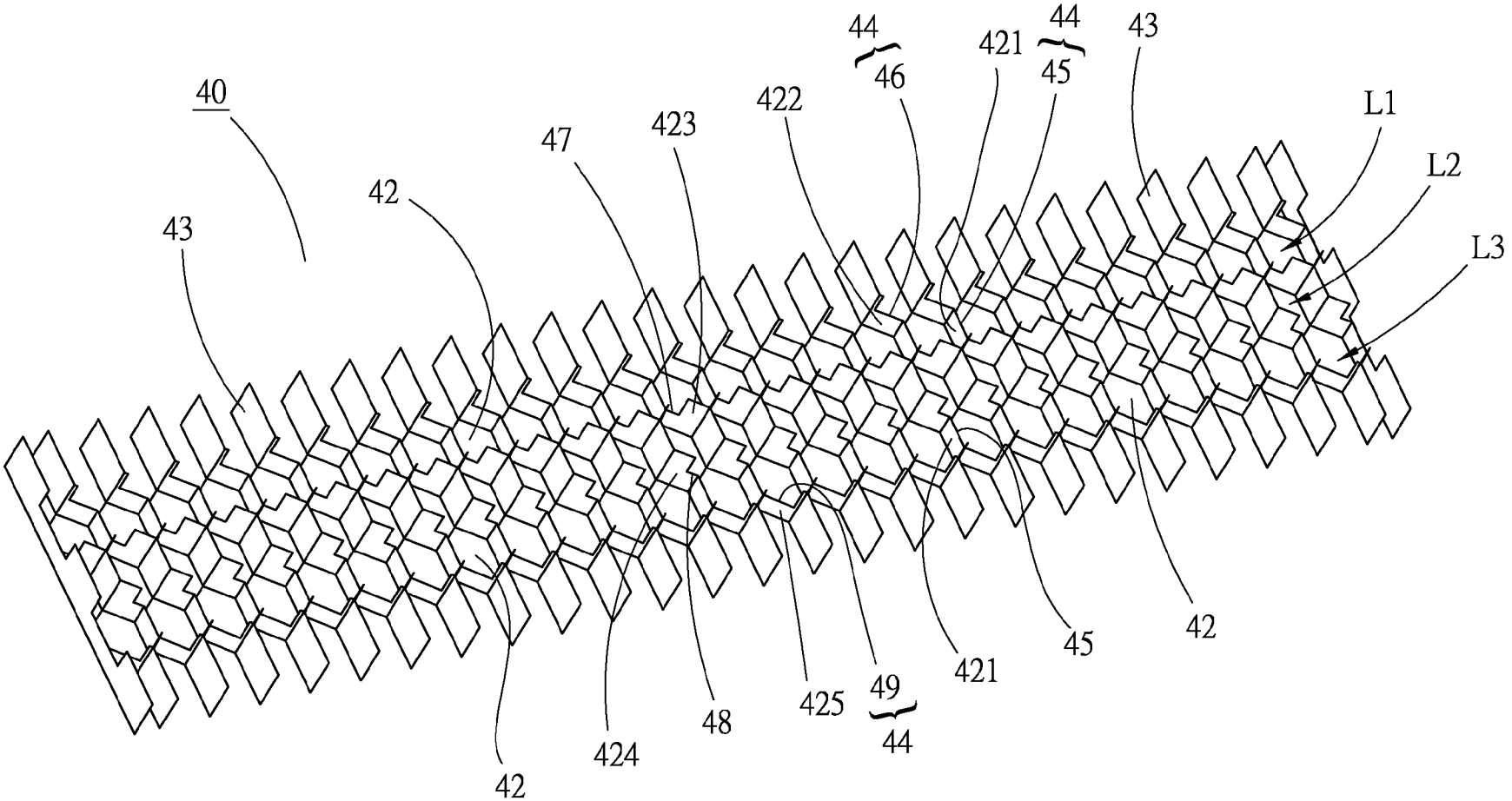
FIG. 5 is a perspective view of the flow guide member of the first embodiment of the present invention.
Figure 6:
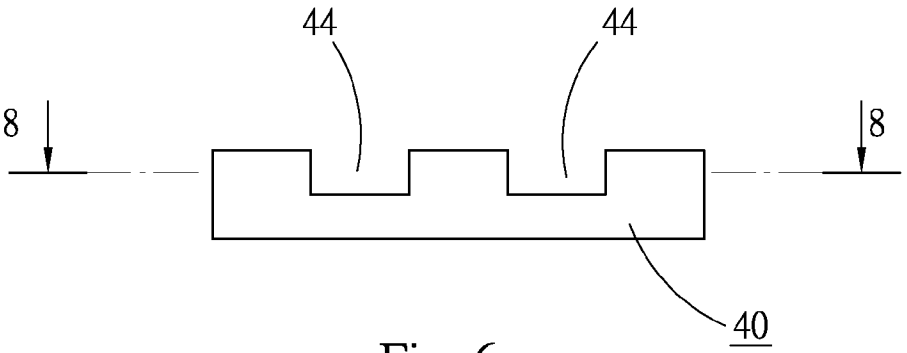
FIG. 6 is an end view according to FIG. 5.
Figure 7:
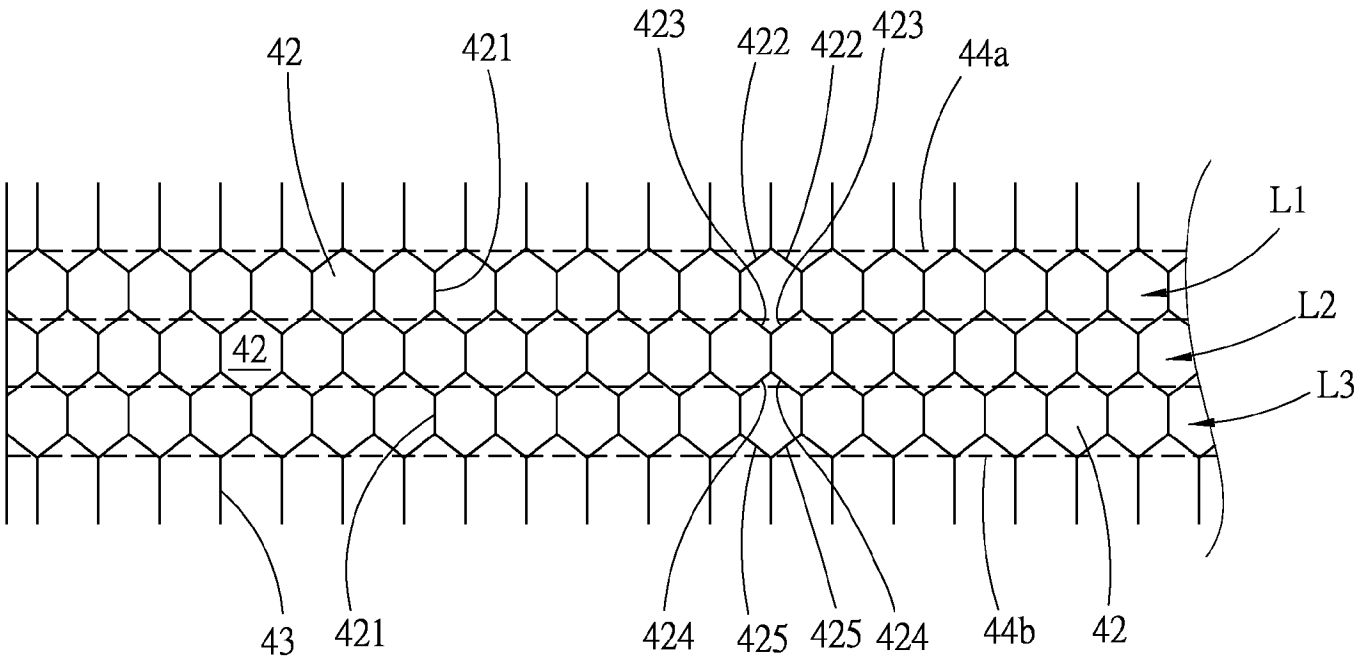
FIG. 7 is a top view according to FIG. 5.

In this embodiment, three elongated flow guide members 40 are installed in the air space 22. Referring to FIGS. 5 to 7, each flow guide member 40 is made of a honeycomb paperboard and has numerous lattices 42 in adjacency to each other. The lattices are arranged in rows, for example, three rows L1 to L3. The longitudinal direction of each lattice row extends along the longitudinal direction of the flow guide member. The first and third lattice rows L1, L3 are positioned on two sides of the flow guide member 40, while the second lattice row L2 is positioned in the middle. Each lattice 42 is a hollow structure composed of continuous surrounding wall faces. The top and bottom ends of the lattice 42 are open. The lattice 42 has a polygonal shape. For example, the lattice 42 can have the form of a triangle, a pentagon, a parallelogram, a square, a rhombus or a hexagon as shown in the drawings. Two air guide channels 44 are longitudinally formed on the top face of the flow guide member 40 and extend from one end of the flow guide member to the other end thereof. The air guide channel has a height approximately one half of the height of the flow guide member. In this embodiment, the air guide channels are generally denoted by reference numeral 44. The specific air guide channel is denoted by reference numeral 44*a* or 44*b*.

Figure 8:
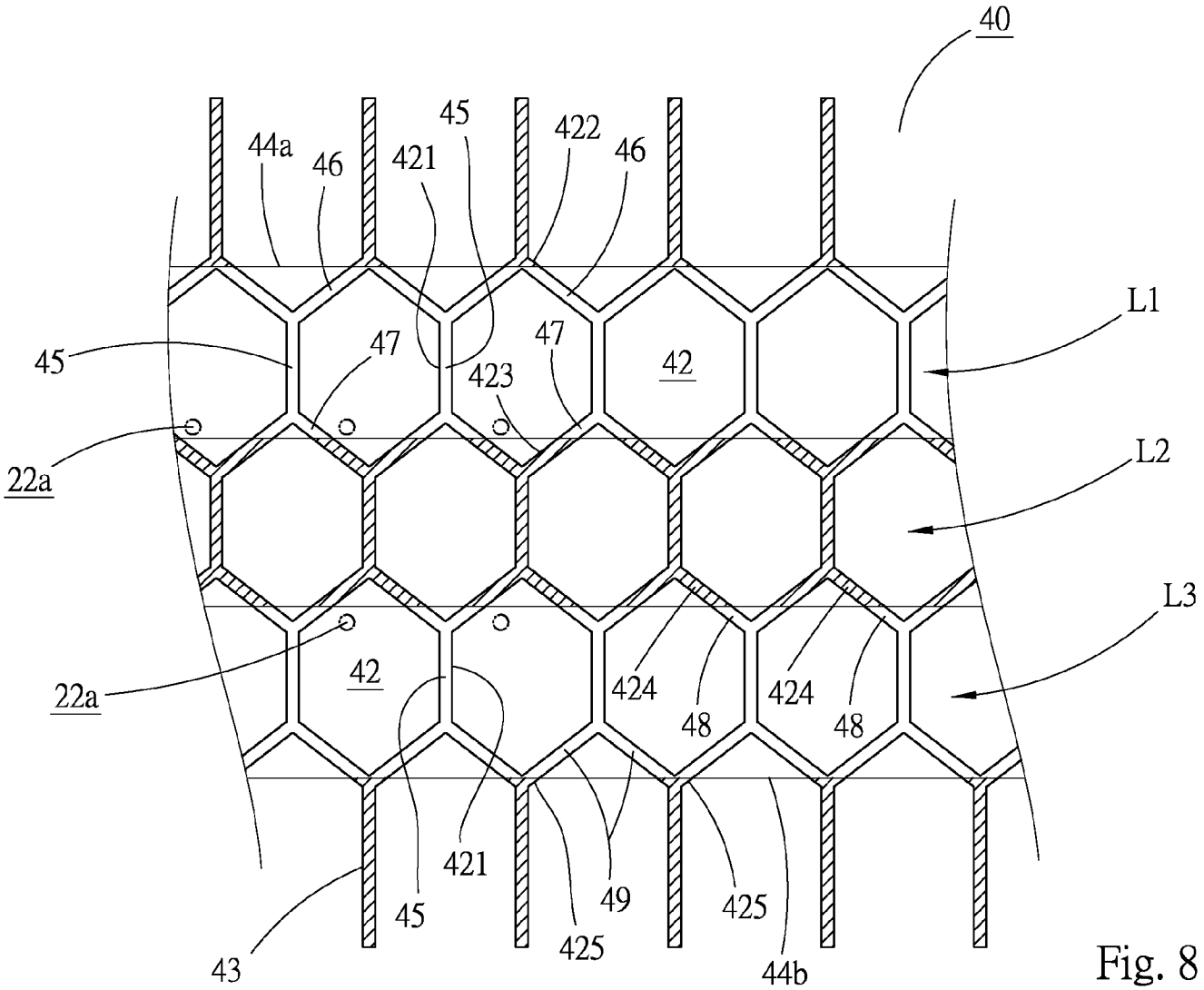
FIG. 8 is a sectional view taken along line 8-8 of FIG. 6.

To easily distinguish between the air guide channels, the straight lines denoted by numeral 44*a* or 44*b* as shown in FIG. 7 show the lines formed of the air guide channel on the flow guide member 40. In the drawings of the specification, the lines of the air guide channel are for illustration purposes only. The first air guide channel 44*a* is disposed between the first lattice row L1 on one side of the flow guide member and the second lattice row L2 in the middle. The second air guide channel 44*b* is disposed between the third lattice row L3 on the other side of the flow guide member and the second lattice row L2. Also referring to FIGS. 5 and 8, with respect to the first and third lattice rows L1, L3 on two sides of the flow guide member, all the middle sections 421 of the lattices 42 are cut off by the air guide channels 44. Each cut off middle section 421 forms a longitudinal notch 45, whereby the air can longitudinally flow along the air guide channel 44. In addition, the lateral walls 422, 423 of two sides of each lattice 42 of the first lattice row L1 are partially cut off by the first air guide channel 44*a*. The cut off part of the outer lateral wall 422 forms a lateral notch 46 and the cut off part of the inner lateral wall 423 also forms a lateral notch 47. The lateral walls 424, 425 of each lattice 42 of the third lattice row L3 are partially cut off by the second air guide channel 44*b*. The cut off part of the inner lateral wall 424 forms a lateral notch 48 and the cut off part of the outer lateral wall 425 also forms a lateral notch 49. Through the lateral notches 46, 49 of the outer lateral walls, the air in the two air guide channels 44 can flow out from the lateral notches to two sides of the flow guide member 40. The lattices 42 of the second lattice row L2 have the lateral walls 423, 424 in common with the lattices of the first lattice row L1 and the lattices of the third lattice row L3 respectively. Therefore, the lateral walls of each lattice 42 of the second lattice row L2 are also partially cut off to form the lateral notches 47, 48. The lattices of the second lattice row L2 communicate with the lattices of the first and third lattice rows L1, L3 through the lateral notches 47, 48 respectively. Therefore, the air in the two air guide channels 44 can also flow between the two air guide channels through the lateral notches 47, 48.

According to the above arrangement, the air guide channels 44 of the flow guide member 40 provide longitudinal airflow passages (formed of the longitudinal notches 45) and transverse airflow passages (formed of the lateral notches 46 to 49). Therefore, the air can flow in both the longitudinal (lengthwise) direction and transverse (widthwise) direction of the flow guide member. The lattices of the three lattice rows L1 to L3 communicate with each other through the lateral notches 47, 48, whereby the air can flow and exchange between the lattices of different lattice rows. In addition, a wing plate 43 outward extends from the outer lateral wall of each lattice 42 of each lateral lattice row. Each two wing plates 43 define therebetween an air outlet for guiding the lateral airflow.

In this embodiment, the fan 50 is installed under the bottom face of the inner board 30 of the flow guide module 15 in alignment with the air inlet 32 as shown in FIG. 4. In FIG. 4, the fan is an axial-flow fan, while in FIG. 2, the fan is a centrifugal fan such as a blower.

In this embodiment, the flow guide member 40 is made of a honeycomb paperboard. The paperboard can be stretched to form a structure as shown in FIG. 5. Before stretched, the paperboard is first cut into the necessary size and configuration by means of a cutting machine. Then the paperboard is easily cut with the air guide channels. Then the cut honeycomb paperboard is stretched to form the flow guide member.

Figure 9:
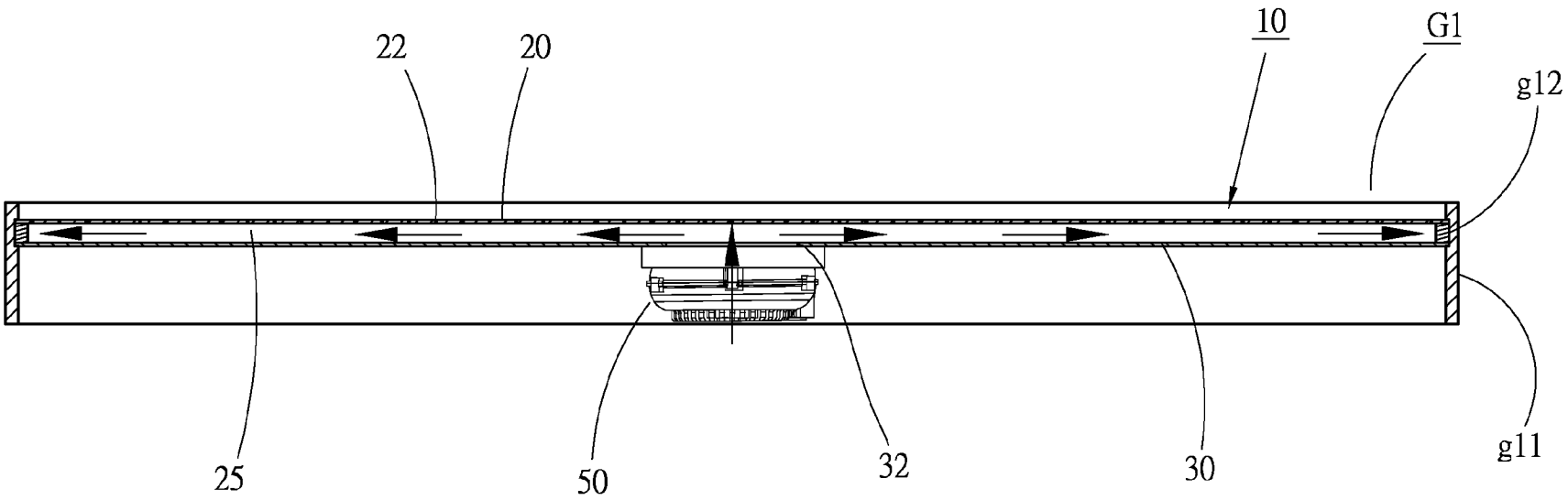
FIG. 9 is a side view showing that the first embodiment of the present invention is installed in the table frame of a game table.

In the case that the air-blowing assembly 10 is installed on the game table G1 or G2, the face board 20 serves as a game face board of a hockey game. Referring to FIG. 9, with the game table G1 taken as an example, the periphery of the flow guide module 15 is inlaid in insertion grooves g12 formed on two end boards and two sideboards of the table frame g11. Accordingly, the flow guide module 15 can be conveniently assembled.

Figure 10:
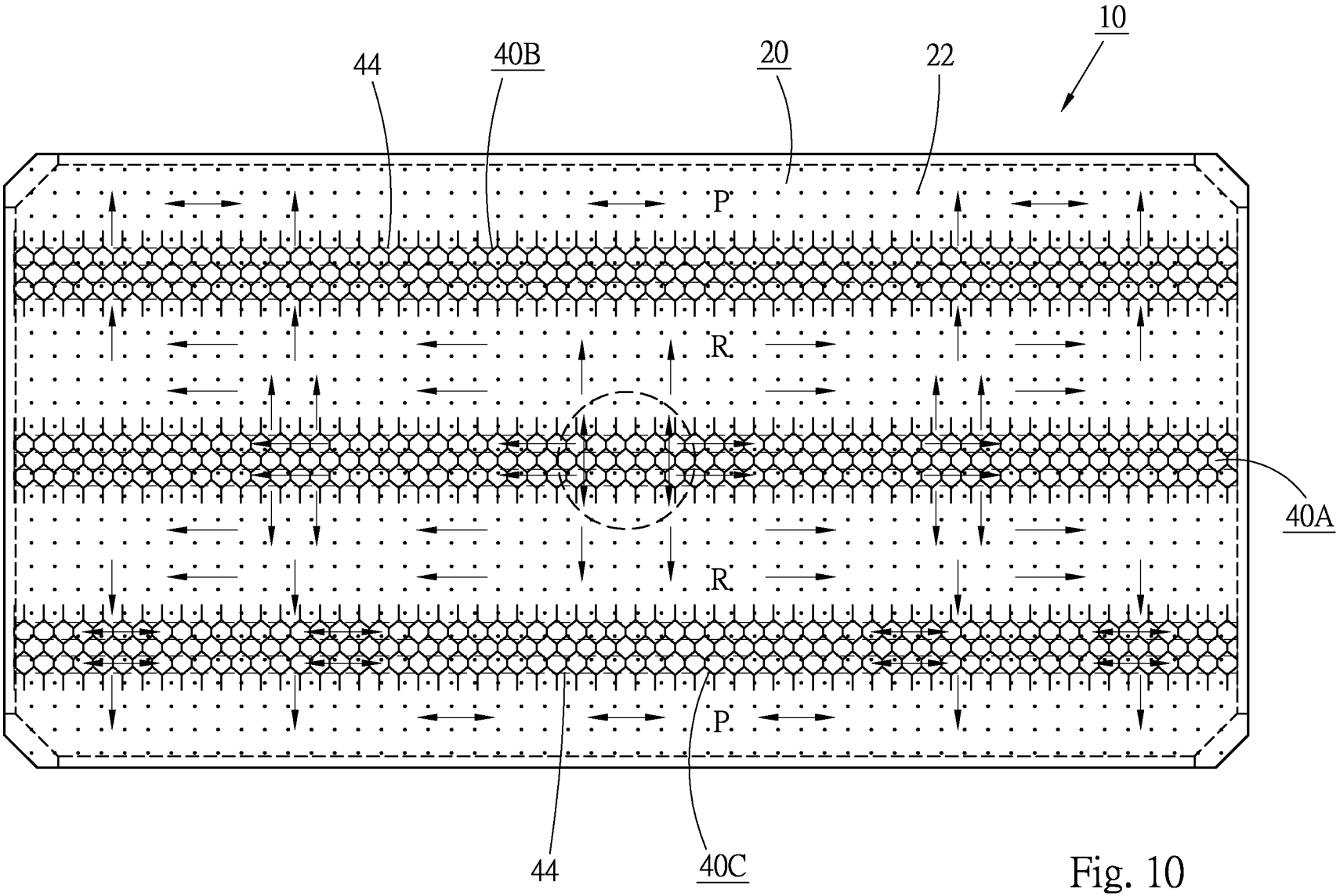
FIG. 10 is a top view of the first embodiment of the present invention, showing that the air is guided to flow in the game table, in which the fan is not shown.

When it is desired to play the hockey game, the fan 50 is powered on to blow airflow from the air inlet 32 of the inner board 30 into the space 25. Referring to FIG. 10, in this embodiment, three flow guide members 40 are arranged in the air space 25 at intervals to partition the air space 25 into multiple compartments R and P. Each flow guide member covers one or more rows of fine orifices 22. Multiple rows of fine orifices are also arranged within the range of each compartment R or P. The air first flows into the flow guide member 40A in the middle and longitudinally and transversely flows along the air guide channels 44 of the flow guide member 40A. After the air flows out of the flow guide member 40A, the air will flow into the compartments R on two sides of the flow guide member 40A and then flow into the other two flow guide members 40B, 40C. Under the guide of the air guide channels 44 of the two flow guide members 40B, 40C, the air will further flow toward the two outermost compartments P. Accordingly, through the longitudinal and transverse airflow passages of the flow guide members 40, the air can flow to every part of the space 25 in all directions and uniformly flow out from the fine orifices 22 of the face board 20 to reduce the resistance against the move of the puck on the face board.

Figure 11:
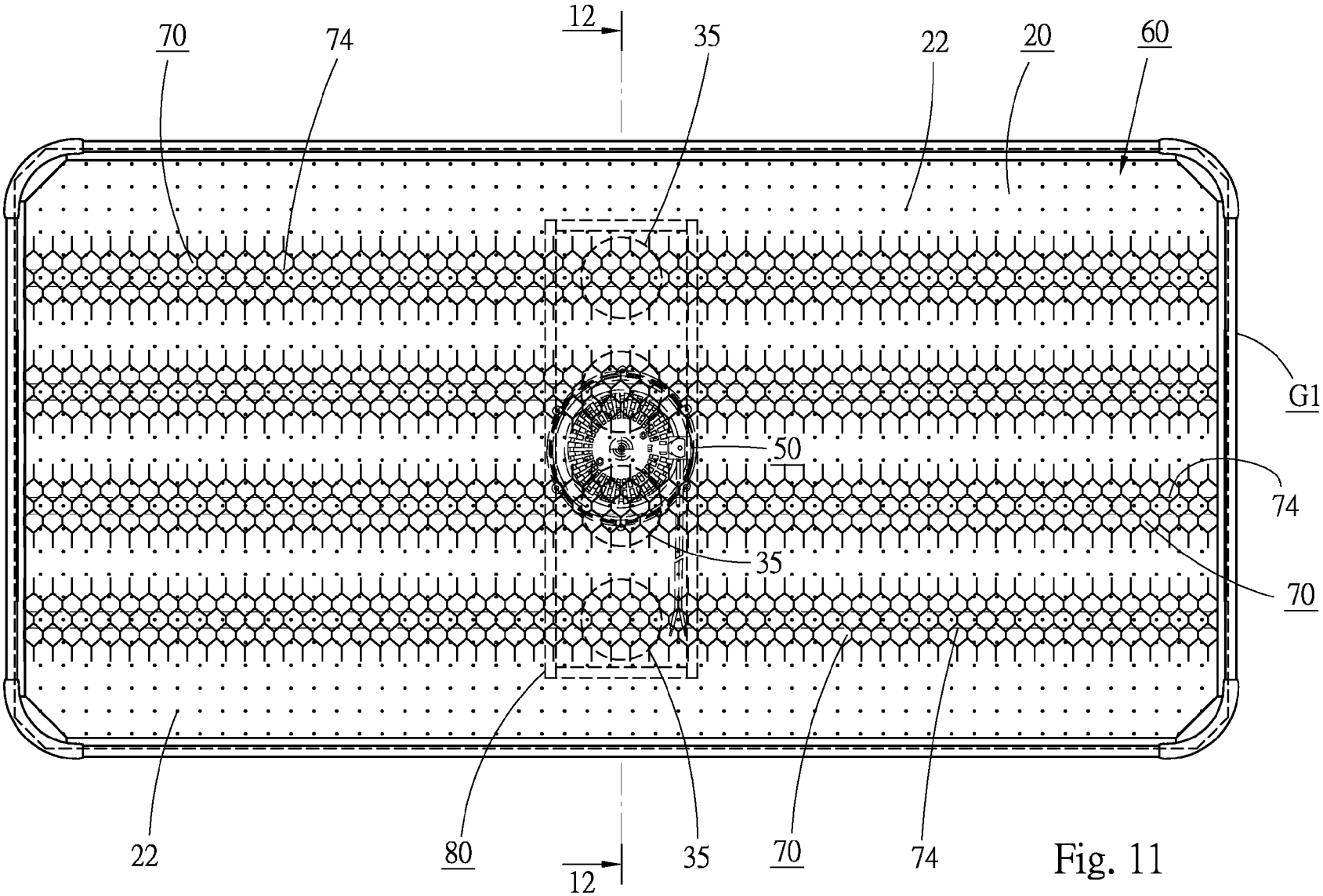
FIG. 11 is a top view of a second embodiment of the present invention.
Figure 12:
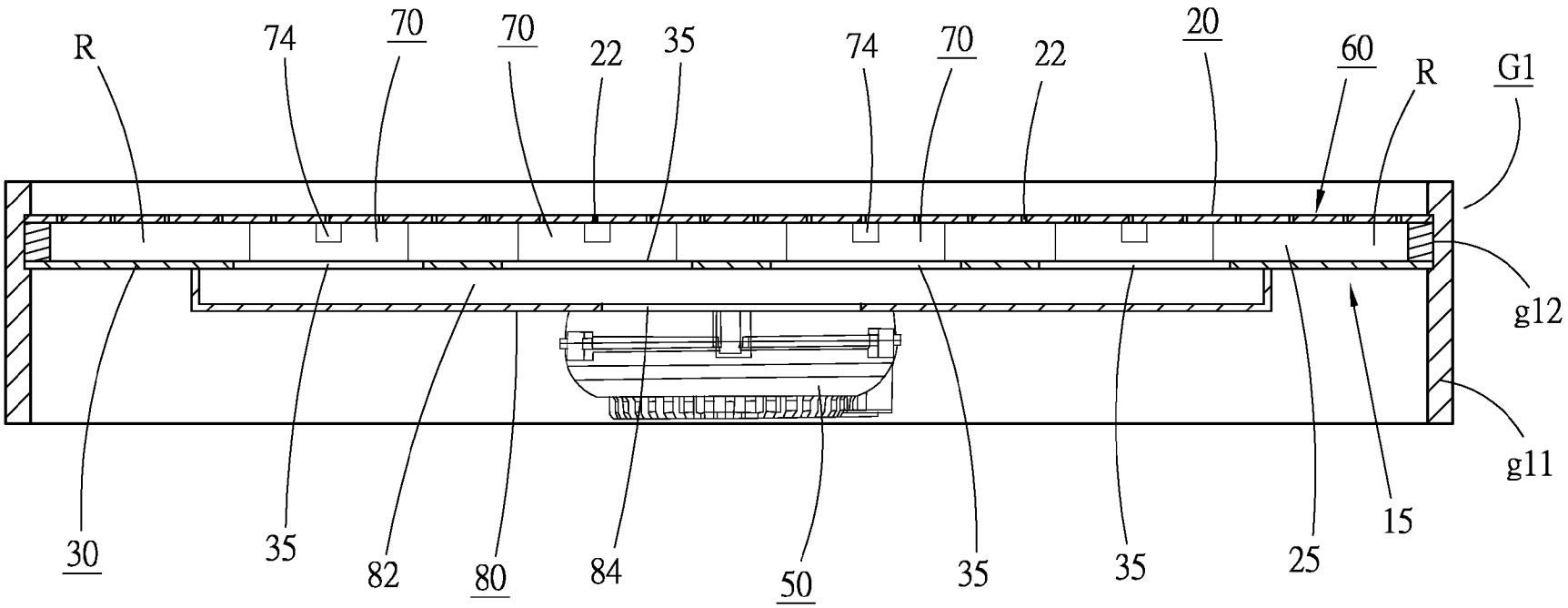
FIG. 12 is a sectional view taken along line 12-12 of FIG. 11.

FIGS. 11 and 12 show a second embodiment of the air-blowing assembly 60 of the present invention. In the second embodiment, the same components are denoted with the same reference numerals as in the first embodiment except the flow guide members and the air inlets.

The flow guide module 15 of the second embodiment is identical to that of the first embodiment, including a face board 20 and an inner board 30. Four flow guide members 70 are arranged in the air space 25. The inner board 30 is formed with four air inlets 35 in alignment with the four flow guide members 70 respectively. An elongated air receptacle 80 is disposed under the bottom face of the inner board 30 to cover the four air inlets 35. The air receptacle 80 defines an internal chamber 82. The fan 50 is positioned under the bottom face of the air receptacle 80 for blowing air from an opening 84 of the air receptacle into the chamber 82, whereby the air can flow from the four air inlets 35 into the air space 25.

Figure 13:
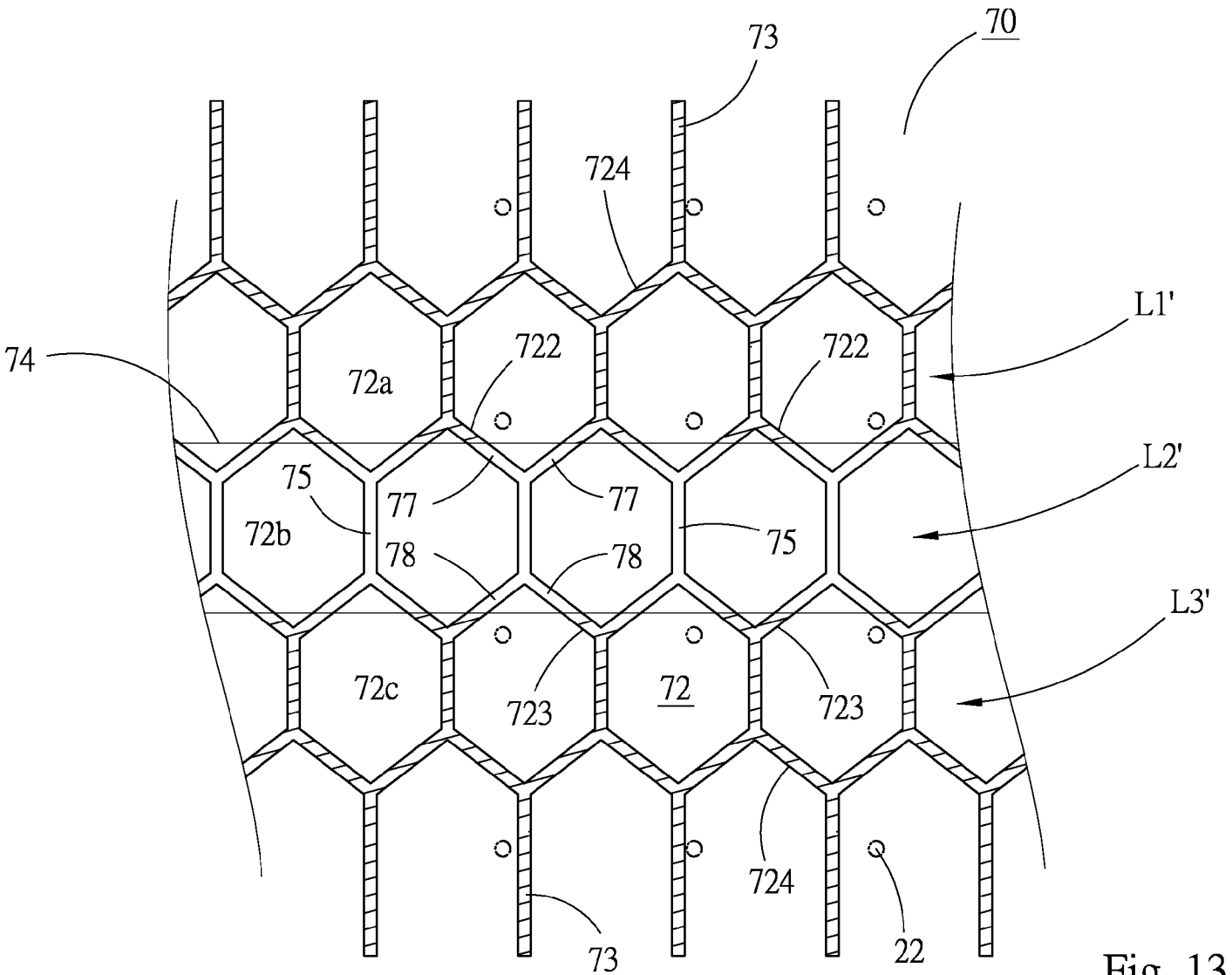
FIG. 13 is a top sectional view of a part of the flow guide member of the second embodiment of the present invention.

Please now refer to FIG. 13. Each flow guide member 70 has numerous lattices 72 in adjacency to each other. The lattices 72 are arranged in three rows L1', L2' and L3'. The lattices 72*a*, 72*b*, 72*c* of different rows have inner walls 722, 723 in common. An air guide channel 74 is longitudinally formed on the top edges of the lattices of the second lattice row L2' of the flow guide member, whereby the lattices of the second lattice row L2' have longitudinal notches 75 and lateral notches 77, 78. The longitudinal notches 75 together form a longitudinal flow passage. The lattices of the first and second lattice rows L1', L2' communicate with each other through the lateral notches 77, while the lattices of the third and second lattice rows L3', L2' communicate with each other through the lateral notches 78. Accordingly, the air can flow along the air guide channel 74 and can flow from the second lattice row L2' toward the first and third lattice rows L1', L3' through the lateral notches 77, 78. In this case, the air can flow out from every fine orifices 22 positioned in the flow guide member. In addition, multiple wing plates 73 are disposed on two sides of the flow guide member.

Figure 14:
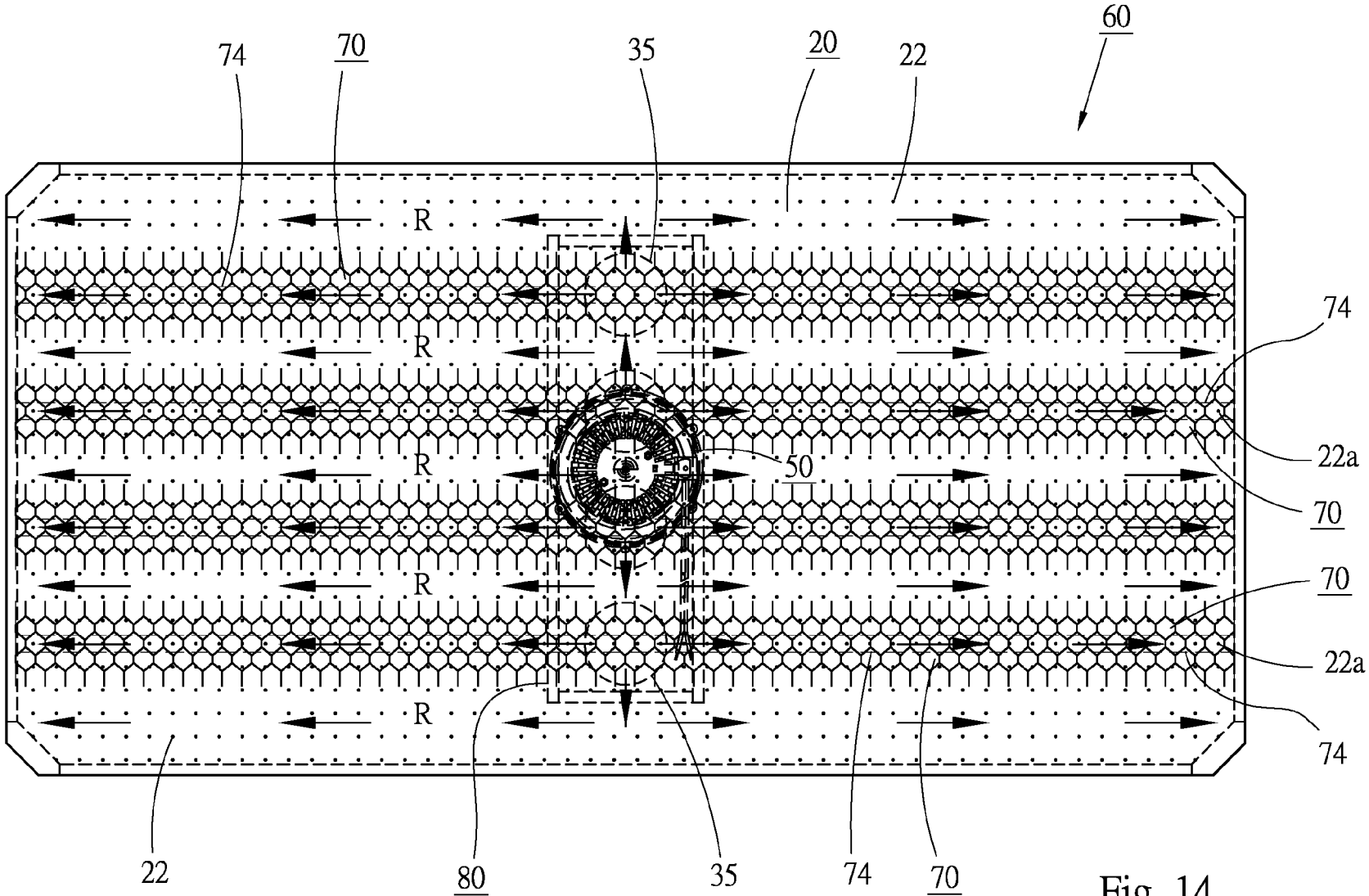
FIG. 14 is a top view of the second embodiment of the present invention, showing that the air is guided to flow in the game table.

Please now refer to FIGS. 12 and 14. The four flow guide members 70 are arranged in the space 25 at intervals to partition the air space 25 into five compartments R. As shown in FIG. 13, the outer walls 724 of the two outermost lattice rows, (that is, the first and third lattice rows L1', L3'), are complete walls free from any lateral notch. Therefore, the flow guide members 70 are isolated from the compartments R without communicating therewith.

In use, the fan 50 blows the air to go from the air inlets 35 into the air space 25 and flow into the flow guide members 70. After the air flows into the flow guide members, the air longitudinally flows along the air guide channels 74 and transversely flows between the lattices of different lattice rows through the lateral notches 77, 78. Accordingly, the air can fill up the flow guide members to flow out from the fine orifices 22. Moreover, the air inlets 35 have a diameter larger than the width of the flow guide members 70 (not including the width of the wing plates 73). Therefore, part of the air is directly blown to the compartments R and flows out of the face board through the fine orifices 22 within the range of the compartments R.

In the above two embodiments, the compartments R and P are elongated narrow spaces with a specific direction. Accordingly, the air can efficiently flow in the longitudinal direction of the face board without producing any turbulence. Also, the flow guide members 40, 70 can make the air smooth flow without producing any turbulence. In addition, it is unnecessary to install the flow guide members in the space 25 with the fine orifices positioned within the range of the air guide channels. For example, as shown in FIG. 14, the flow guide member can be installed in the space 25 with one row of fine orifices 22*a* positioned within the range of the air guide channel 74. Alternatively, as shown in FIG. 13, the flow guide member can be installed in the space 25 without any fine orifice positioned within the range of the air guide channel 74.

The design of the air receptacle 80 and the multiple air inlets 35 of the second embodiment is also applicable to the first embodiment.

Figure 15:
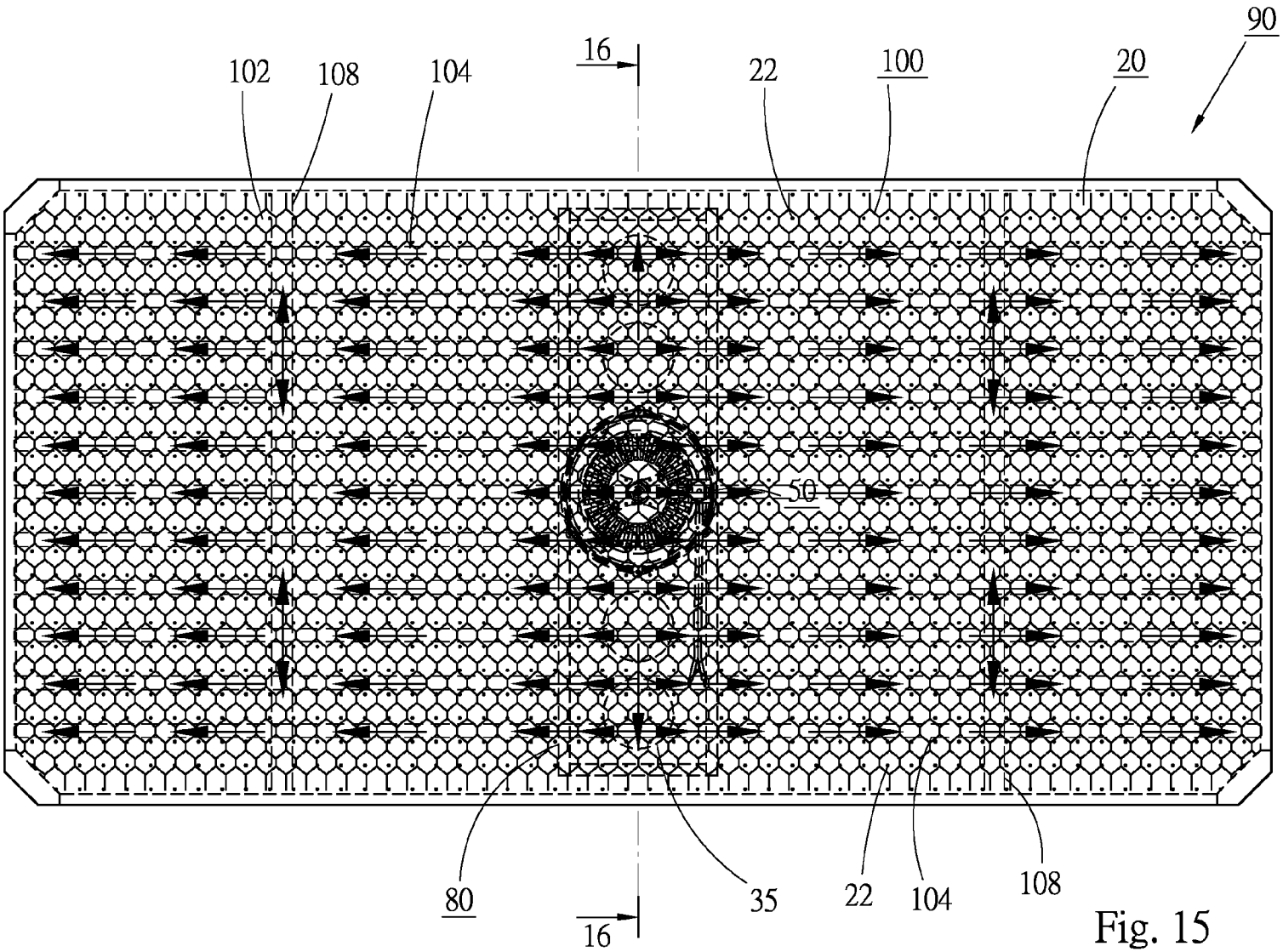
FIG. 15 is a top view of a third embodiment of the present invention, showing that the air is guided to flow in the game table.
Figure 16:
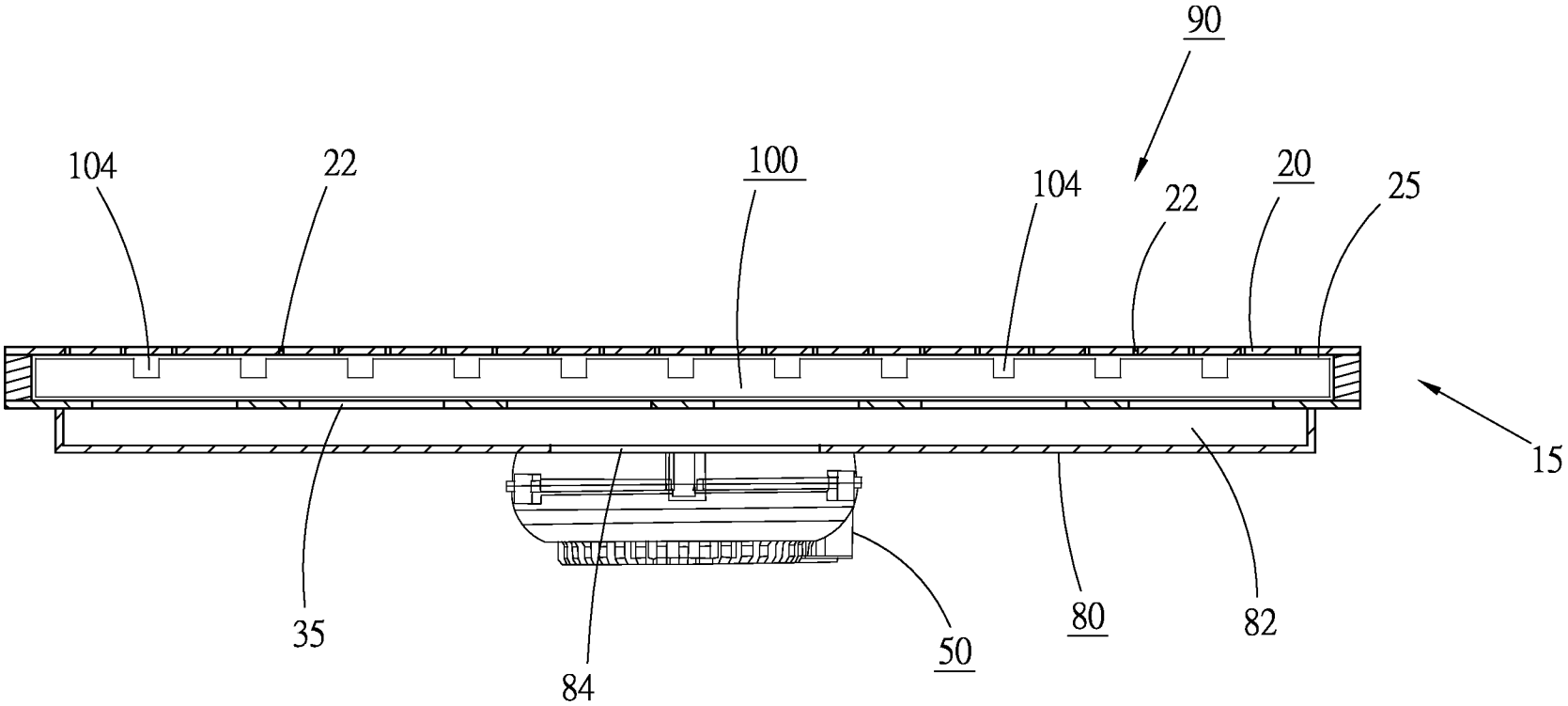
FIG. 16 is a sectional view taken along line 16-16 of FIG. 15.

FIGS. 15 and 16 show a third embodiment of the air-blowing assembly 90 of the present invention. In the third embodiment, the same components are denoted with the same reference numerals as in the second embodiment except the flow guide members.

The flow guide module 15, the face board 20, the inner board 30, the air inlets 35, the fan 50 and the air receptacle 80 of the third embodiment are identical to those of the second embodiment and thus will not be repeatedly described hereinafter.

Figure 17:
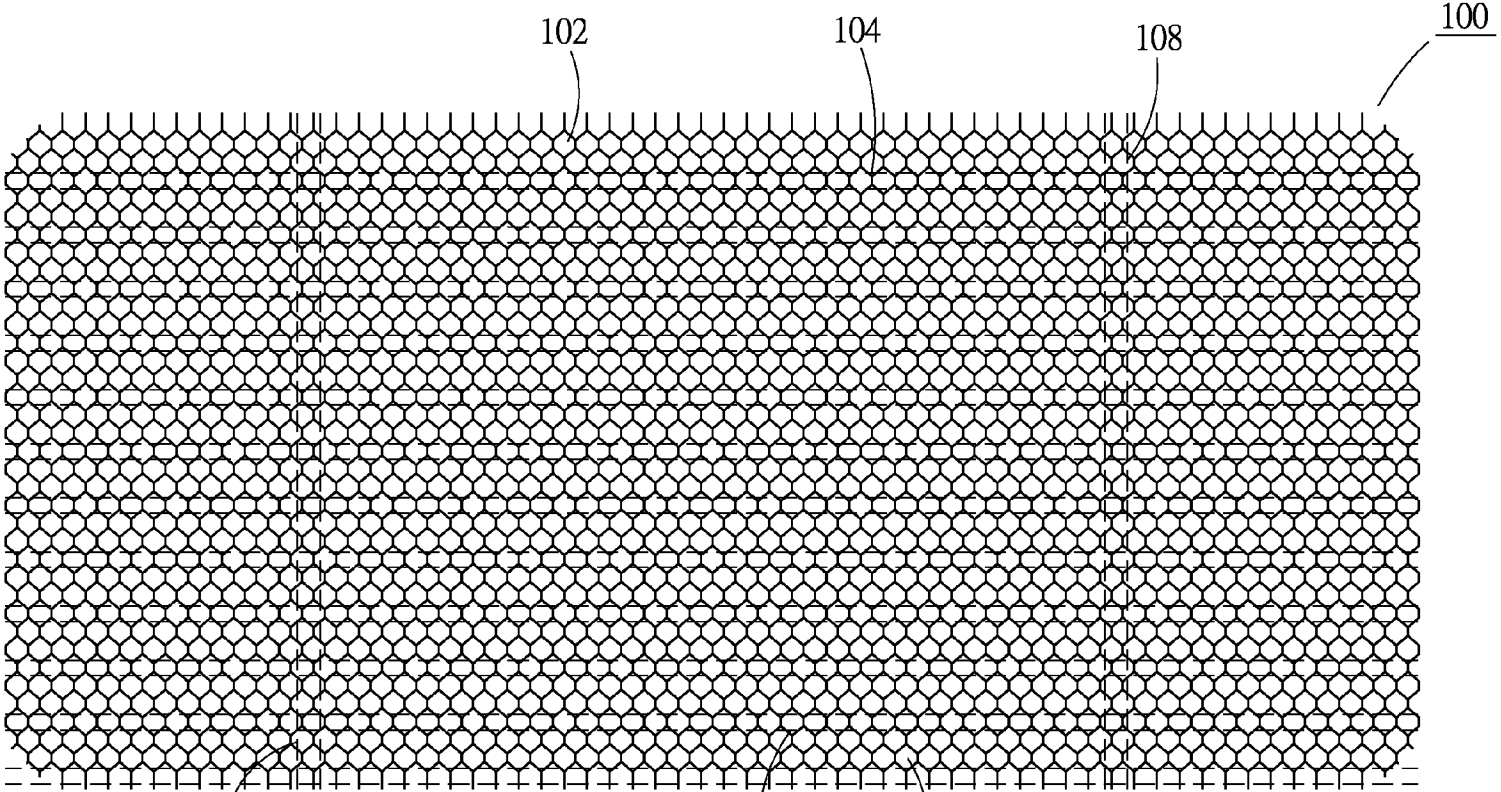
FIG. 17 is a top sectional view of the flow guide member of the third embodiment of the present invention.

Please refer to FIGS. 16 and 17. In the third embodiment, a one-piece flow guide member 100 is installed in the air space 25. The flow guide member 100 has numerous lattices 102 in adjacency to each other. The lattices are arranged in rows along the length of the flow guide member. The flow guide member has an area approximately equal to the area of the space 25. Multiple longitudinal air guide channels 104 are formed on the top face of the flow guide member in a longitudinal direction thereof.

When the fan 50 blows the air into the space 25, the flow guide member 100 can guide the air to flow out from the fine orifices 22 of the face board.

Figure 19:
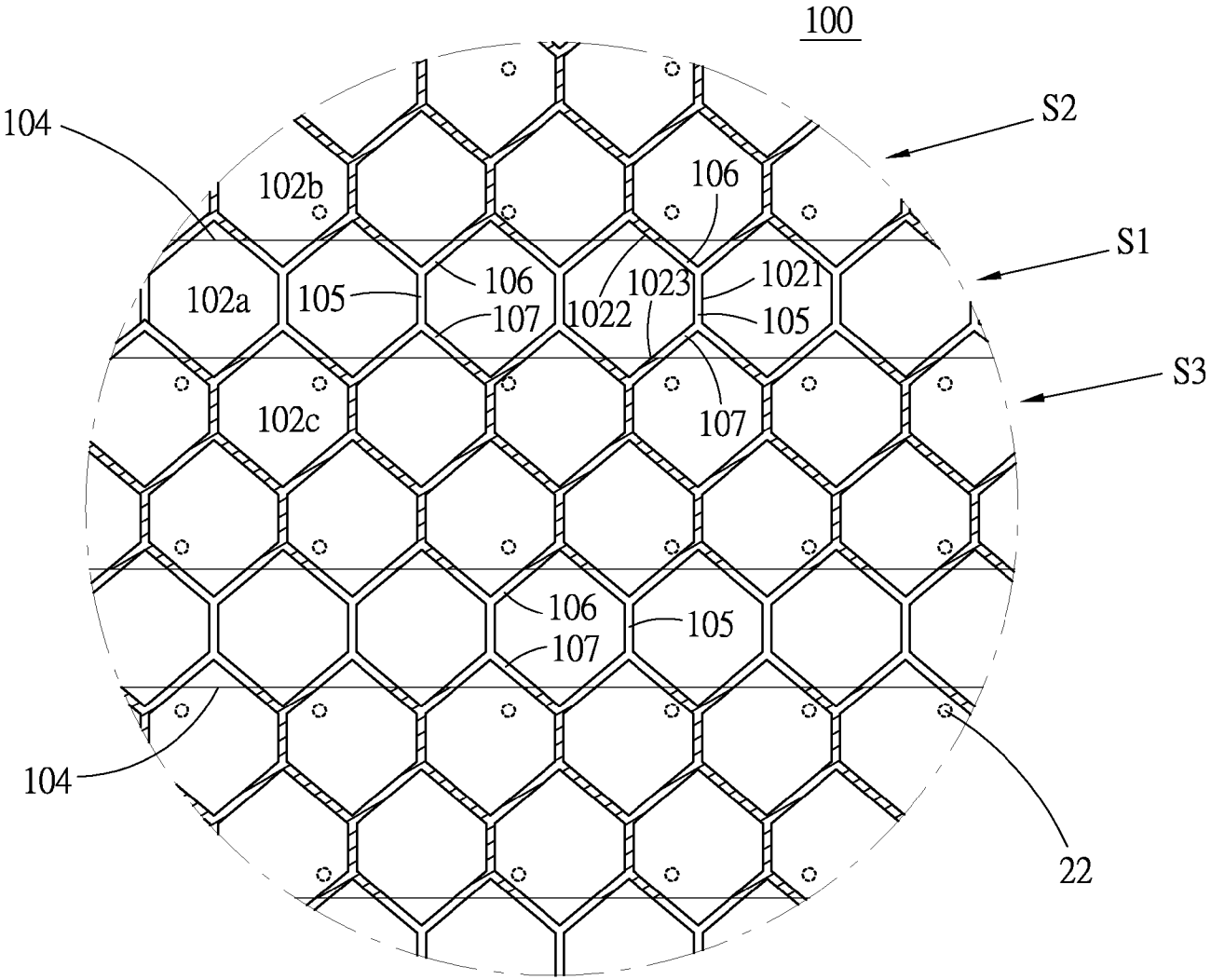
FIG. 19 is an enlarged sectional view of apart of the flow guide member of the third embodiment of the present invention.

In this embodiment, the air guide channels are regularly disposed on the flow guide member 100. Each three lattice rows are provided with an air guide channel. Please refer to FIG. 19. With three lattice rows S1 to S3 taken as example for illustration, the lattice row S1 is a middle lattice row, while the lattice rows S2 and S3 are left and right lattice rows. The air guide channel 104 is disposed along the middle lattice row S1. Each lattice 102*a* of the middle lattice row S1 has a middle section 1021 and lateral walls 1022, 1023. The lattice 102*a* of the middle lattice row S1 shares the lateral walls 1022, 1023 with the lattices 102*b*, 102*c* of the left and right lattice rows S2, S3. The middle section 1021 is cut off by the air guide channel 104 to form a longitudinal notch 105, while the lateral walls 1022, 1023 are partially cut off to form lateral notches 106, 107. The longitudinal notches 105 together form a longitudinal airflow passage. The air can flow between the lattices of the three lattice rows S1 to S3 through the lateral notches 106, 107. Accordingly, as shown in FIGS. 15 and 16, after the fan 50 blows the air into the space 25, the air will flow into all air guide channels 104 and then flow to every lattice row under the guide of the air guide channels 104. In this case, the air can flow to every part of the flow guide member 100 and then flow out from all the fine orifices 22.

Figure 18:
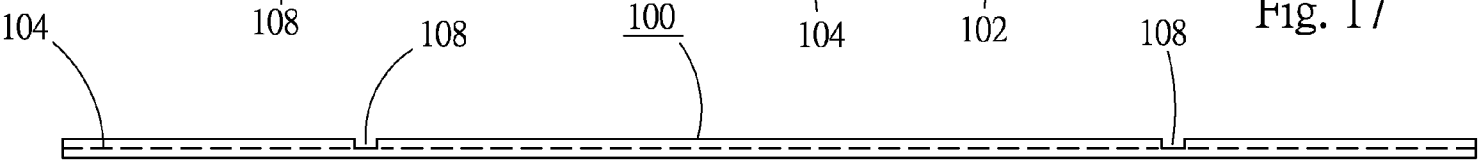
FIG. 18 is a front view according to FIG. 17.

Please refer to FIGS. 17 and 18. Two transverse air guide channels 108 are further disposed on the flow guide member 100 in communication with the longitudinal air guide channels 104. Accordingly, the air can flow to other lattice rows through the transverse air guide channels 108. In this case, the air can flow within the flow guide member 100 at higher efficiency. The structure of the transverse air guide channel 108 is the same as the longitudinal air guide channel 104 and thus will not be repeatedly described.

It should be noted that in this embodiment, alternatively, an air guide channel is provided for each two lattice rows, rather than three lattice rows.

Figure 20:
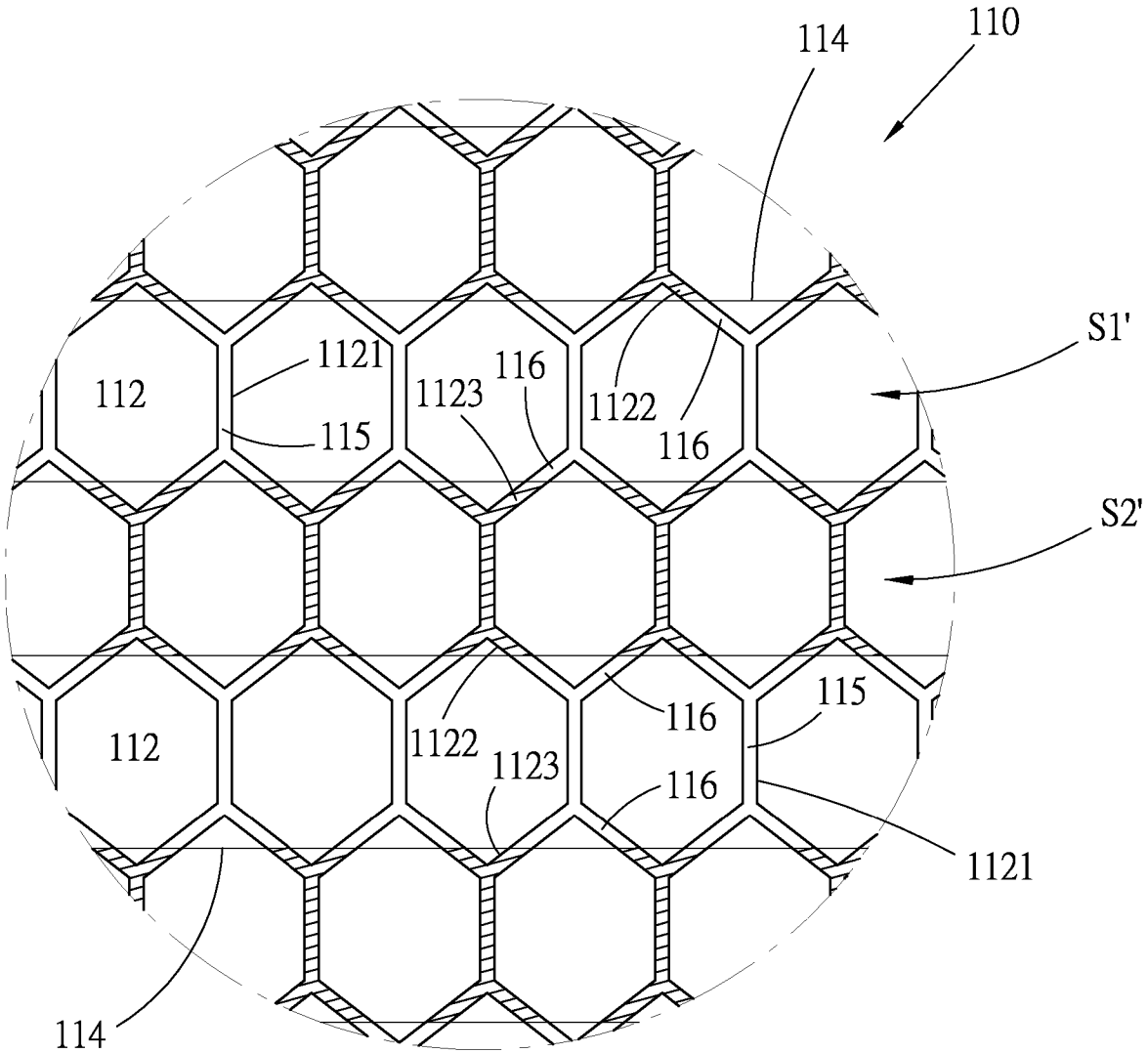
FIG. 20 is a top sectional view of a part of the flow guide member of a fourth embodiment of the present invention.

FIG. 20 shows the flow guide member 110 of a fourth embodiment of the present invention. The flow guide member 110 can be used in any of the air-blowing assemblies of the above embodiments.

The flow guide member 110 is a one-piece honeycomb paperboard identical to that of the third embodiment. The flow guide member 110 has numerous lattices 112 arranged in rows. An air guide channel 114 is provided for each two lattice rows S1' and S2'. The air guide channel 114 is disposed on the lattice row S1' of the two lattice rows. The middle section 1121 of each lattice 112 of the lattice row S1' is cut off by the air guide channel 114 to form a longitudinal notch 115, while the lateral walls 1122, 1123 of the lattice 112 are partially cut off by the air guide channel 114 to form lateral notches 116. After the air goes into the air guide channels 114, the air can flow along the longitudinal notches 115 in the longitudinal direction of the air guide channel. Also, the air can transversely flow to other lattice rows through the lateral notches 116. In this case, the air can transversely flow from one air guide channel 114 to another air guide channel through the lateral notches. Accordingly, the air can longitudinally and transversely flow between the lattice rows of the flow guide member and flow to every part of the air space 25 under the guide of the flow guide member.

Figure 21:
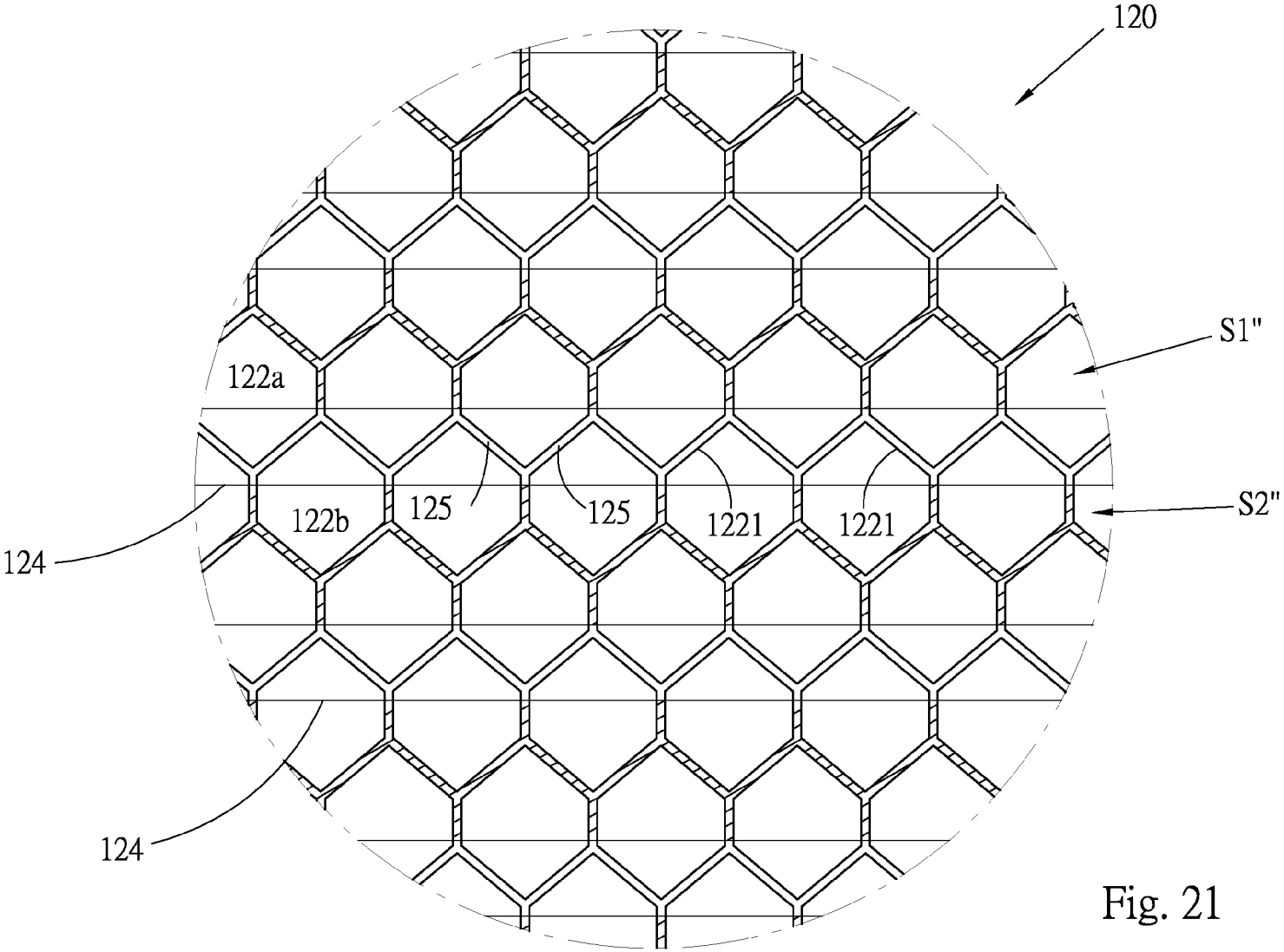
FIG. 21 is a top sectional view of a part of the flow guide member of a fifth embodiment of the present invention.

FIG. 21 shows the flow guide member 120 of a fifth embodiment of the present invention. In the fifth embodiment, an air guide channel 124 is disposed between each two lattice rows S1" and S2". The air guide channel is mainly disposed on the lateral walls 1221 shared by the two lattice rows to form lateral notches 125. The air can flow between the lattices 122*a*, 122*b* of the two lattice rows through the lateral notches 125. Accordingly, the air can flow to every part of the flow guide member 120 and then flow out from the fine orifices of the face board.

The air guide channel disposed on the lateral walls shared by the lattices of this embodiment is also applicable to the flow guide member having at least two lattice rows.

The present invention provides a novel flow guide design for the hockey game table, which can guide the air to flow within the interior of the game table. By means of the flow guide design, the air can efficiently flow to every fine orifice of every part of the air space to create a uniform air-blowing effect.

The air-blowing assembly of the present invention has a modularized structure and is easy to install on the game table. Therefore, the production rate is increased.

In the preferred embodiments of the present invention, the flow guide member made of the paperboard is used instead of the conventional wooden wind-guiding board. The paperboard is easy to cut so that the flow guide member can be easily manufactured. In comparison with the wooden wind-guiding board, the cost is greatly lowered. After cut, the flow guide member has a uniform thickness and is planer than the wooden board. The flow guide member of the present invention has regular internal flow passages extending in all directions so that the resistance against the flowing of the air is smaller than that of the wooden wind-guiding board.

In addition, the flow guide member of the present invention is made of less material than the wooden board and is lighter than the wooden board to meet the requirement of lightening. The flow guide member has a structural strength sufficient for bearing the load. Moreover, the flow guide member is made of recoverable paper to meet the requirement of environmental protection.

The above embodiments are only used to illustrate the present invention, not intended to limit the scope thereof. Many modifications of the above embodiments can be made without departing from the spirit of the present invention. For example, the flow guide member can be alternatively made of plastic material and the number of the air guide channels of the flow guide member is not limited to that of the above embodiments.

What is claimed is:

1. An air-blowing assembly of a game table, the air-blowing assembly being installed in a table frame of a game table, the air-blowing assembly comprising: a flow guide module and at least one fan;

the flow guide module including:

a face board formed with multiple fine orifices;

an inner board positioned under the face board to define an air space between the face board and the inner board; at least one air inlet being disposed on the flow guide module in communication with the air space;

at least one flow guide member having multiple hollow lattices in adjacency to each other, the lattices being arranged in at least two rows; at least one air guide channel being disposed on the flow guide member in a longitudinal direction of the flow guide member, the air guide channel having a height smaller than that of the flow guide member; the flow guide member being disposed in the air space; each lattice row on which the air guide channel is disposed having notches selected from a group consisting of multiple longitudinal notches, multiple lateral notches and a combination thereof; and the fan serving to blow air from the air inlet into the air Space and through the multiple hollow lattices;

wherein an interior of one lattice of the multiple hollow lattices of the at least two rows communicating with interiors of adjacent lattices of the multiple hollow lattices of the at least two rows through the notches.

2. The air-blowing assembly as claimed in claim 1, wherein the table frame of the game table has a rectangular form; an insertion groove being formed on an inner periphery of the table frame; a periphery of the flow guide module being disposed in the insertion groove.

3. The air-blowing assembly as claimed in claim 1, wherein the fan is disposed under a bottom face of the inner board in alignment with the air inlet.

4. The air-blowing assembly as claimed in claim 1, wherein the inner board is formed with at least two air inlets; the air-blowing assembly further comprising an air receptacle disposed under a bottom face of the inner board to cover the air inlets, the air receptacle defining an internal chamber; the fan being installed on a periphery of the air receptacle.

5. The air-blowing assembly as claimed in claim 1, wherein the table frame is pivotally rotatably disposed on a table body of the game table; the fan being disposed on the table body; a wind conduit being arranged between the table body and the table frame and connected between the fan and the air-blowing assembly.

6. The air-blowing assembly as claimed in claim 1, wherein multiple wing plates are disposed on outer walls of two sides of each flow guide member; the air guide channel being disposed on a top face of the flow guide member.

7. An air-blowing assembly of a game table, the air-blowing assembly being installed in a table frame of a game table, the air-blowing assembly comprising:

a face board formed with multiple fine orifices passing through the face board;

an inner board positioned under the face board to define an air space between the face board and the inner board; at least one air inlet being disposed on the inner board;

at least two flow guide members each having multiple hollow lattices in adjacency to each other, the lattices being arranged in at least two rows; at least one air guide channel being disposed on each flow guide member in a longitudinal direction of the flow guide member; the air guide channel having a height smaller than that of the flow guide member; each the air guide channel having the lattices of at least one lattice row formed with notches selected from a group consisting of multiple longitudinal notches, multiple lateral notches and a combination thereof; the flow guide members being disposed in the air space to partition the air space into multiple elongated compartments; and at least one fan for blowing air from the air inlet into the air space and through the multiple hollow lattices;

wherin an interior of one lattice of the multiple hollow lattices of the least two rows communicating with interiors of adjacent lattices of the multiple hollow lattices of the at least two rows through the notches.

8. The air-blowing assembly as claimed in claim 7, wherein each flow guide member has multiple lattices arranged in three rows including a first lattice row and a third lattice row positioned on two sides of the flow guide member and a second lattice row positioned in the middle of the flow guide member; a first air guide channel being disposed between the first and third lattice rows; a second air guide channel being disposed between the third and second lattice rows.

9. The air-blowing assembly as claimed in claim 8, wherein each lattice of the multiple has a middle section and lateral walls on two sides; the middle sections of each lattice of the first and third lattice rows being cut off. by the first or second air guide channel to form a longitudinal notch; the lateral walls of each lattice of the first and third lattice rows being partially cut off by the first or second air guide channel, the outer lateral wall thereof being partially cut off to form a lateral notch, while the inner lateral wall thereof being partially cut off to form another lateral notch; each lattice of the second lattice row sharing the inner lateral walls with the lattices of the first and third lattice rows respectively, whereby the lateral walls of each lattice of the second lattice row are also formed with lateral notches.

10. The air-blowing assembly as claimed in claim 7, wherein each flow guide member has multiple lattices arranged in three rows including a first lattice row and a third lattice row positioned on two sides of the flow guide member and a second lattice row positioned in the middle of the flow guide member; an air guide channel being disposed on the second lattice row; the middle sections of the lattices of the second lattice row being formed with longitudinal notches, and the lateral walls on at least one side of the lattices of the second lattice row being formed with lateral notches.

11. The air-blowing assembly as claimed in claim 7, wherein the inner board is formed with at least two air inlets in alignment with the flow guide members respectively.

12. The air-blowing assembly as claimed in claim 11, wherein the two air inlets have a diameter larger than the width of the flow guide members.

13. The air-blowing assembly as claimed in claim 7,wherein the lattices of each two lattice rows share lateral walls therebetween and each the air guide channel is disposed on the shared lateral walls.

14. An air-blowing assembly of a game table, the air-blowing assembly being installed in a table frame of a game table, the air-blowing assembly comprising:

a face board formed with multiple fine orifices passing through the face board;

an inner board positioned under the face board to define an air space between the face board and the inner board; at least one air inlet being disposed on the inner board;

a flow guide member having multiple hollow lattices in adjacency to each other, the lattices being arranged in more than three rows; multiple longitudinal air guide channels being disposed on the flow guide member in a longitudinal direction of the lattice rows at intervals, the air guide channels having a height smaller than that of the flow guide member; each of the air guide channels having the lattices of at least one lattice row formed with notches selected from a group consisting of multiple longitudinal notches, multiple lateral notches and a combination thereof; the flow guide members being disposed in the air space; and at least one fan for blowing air from the air inlet into the air space and through the multiple hollow lattices;

wherein an interior of one of the multiple hollow lattices of the at least two rows communicating with interiors of adjacent lattices of the multiple hollow lattices of the at least two rows through the notches.

15. The air-blowing assembly as claimed in claim 14, further comprising at least one transverse air guide channel disposed on the flow guide member in a transverse direction of the lattice rows in communication with the longitudinal air guide channels.

16. The air-blowing assembly as claimed in claim 14, wherein each air guide channel is disposed on one lattice row, the middle sections of the lattices of the lattice row being cut off to form longitudinal notches, and the lateral walls on at least one side of the lattices of the lattice row being cut off to form lateral notches.

17. The air-blowing assembly as claimed in claim 14, wherein the lattices of each two lattice rows share lateral walls therebetween and each the air guide channel is disposed on the shared lateral walls.

18. The air-blowing assembly as claimed in claim 14, wherein each three lattice rows include a lattice row in the middle; an air guide channel of the multiple air guide channels being disposed on the middle lattice row, the lattices of the middle lattice row being formed with longitudinal notches and lateral notches.

19. The air-blowing assembly as claimed in claim 14, wherein the flow guide member has an area approximately equal to the area of the air space.

20. The air-blowing assembly as claimed in claim 14, wherein the inner board is formed with at least two air inlets; the air-blowing assembly further comprising an air receptacle disposed under a bottom face of the inner board to cover the air inlets, the air receptacle defining an internal chamber; the fan being installed on a periphery of the air receptacle.

* * * * *